US006019058A

United States Patent [19]

Salyer et al.

[11] Patent Number: 6,019,058

[45] Date of Patent: Feb. 1, 2000

[54] LOOPED MOORING LINE AND METHOD OF INSTALLATION

[75] Inventors: Brent A. Salyer, Cypress; Arun S. Duggal, Houston; Johnny P. Fougeron, Cypress, all of Tex.

[73] Assignee: FMC Corporation, Chicago, Ill.

[21] Appl. No.: 09/098,576

[22] Filed: Jun. 17, 1998

Related U.S. Application Data

[60] Provisional application No. 60/050,262, Jun. 19, 1997.

[51] Int. Cl.[7] ..... B63B 21/20

[52] U.S. Cl. ..... 114/230.2; 114/293

[58] Field of Search ..... 114/293, 230.23, 114/230.24, 230.2, 253, 254, 230.11

[56] References Cited

U.S. PATENT DOCUMENTS

| | | | |
|---|---|---|---|
| 1,392,668 | 10/1921 | Walton | 114/230.23 |
| 4,067,282 | 1/1978 | Guinn et al. . | |
| 4,509,448 | 4/1985 | Pease et al. | 114/230.12 |
| 5,168,823 | 12/1992 | Sheppard, Jr. . | |
| 5,544,608 | 8/1996 | Horton, III . | |
| 5,566,636 | 10/1996 | Wolf et al. | 114/293 |

FOREIGN PATENT DOCUMENTS

| | | | |
|---|---|---|---|
| 438258 | 7/1991 | European Pat. Off. | 114/293 |

*Primary Examiner*—Sherman Basinger

*Attorney, Agent, or Firm*—Gary L. Bush; Mayor, Day, Caldwell & Keeton LLP.

[57] ABSTRACT

A method and apparatus for replacing an existing looped non-metallic mooring line (20) from a floating anchor handling vessel (10) anchored to the sea floor. The existing looped line (20) extends about a sheave (34) adjacent a subsea anchor means (24) and opposed ends (26) of the looped line (20) are connected to a mounting member (30) on the vessel (10) for securing the ends (26) of the existing mooring line (20). The new replacement line (20A) is attached to an end of the looped existing line (20) and the old existing line (20) is hauled in while the looped replacement line (20A) is payed out from the vessel (10) about the sheave (34) for return to the vessel. The looped replacement line (20A) is disconnected from the old line (20) and the ends of the new replacement line (20A) are secured to a mounting member (30) on the vessel. The existing mooring line (20) is preferably replaced by the anchor handling vessel (10) while a main floating, production, storage and offloading (FPSO) vessel (12) remains moored to the sea floor by the remaining mooring legs or lines.

18 Claims, 4 Drawing Sheets

LOOPED MOORING LINE AND METHOD OF INSTALLATION

REFERENCE TO RELATED PROVISIONAL APPLICATION

This application claims the benefit of United States provisional application No. 60/050,262 filed Jun. 19, 1997.

BACKGROUND OF THE INVENTION

1. Field of the Invention

This invention relates to any mooring line configured with both ends connected to a common mounting member on a vessel, with the midpoint of the line looped through a sheave at the lower end for anchoring a vessel to the sea floor. This looped configuration provides a method and apparatus for installing a mooring line for a vessel, or for replacing an existing mooring line, and permits a moored vessel to remain moored to remaining anchor legs, 2. Description of the Prior Art Heretofore, vessels or ships have been moored or anchored by various arrangements. Anchor lines or anchor legs attached to the vessel extend to anchors or pilings on the sea bed for mooring the vessel. Chains or wire cables are normally connected to winches or capstans on the vessel for installation or de-installation of the anchor lines with stoppers used for permanent attachment.

Subsea wells are being drilled at increasing water depths of over four thousand (4,000) feet. If formed of metal chains or metal cables, anchor lines increase greatly in weight for the greater water depths. It is desirable to use soft or non-metallic mooring lines in many instances because such lines are lightweight have more elasticity and are easily wound on a winch or the like and turn easily about pulleys or sheaves. Looped lines permit anchor loads to be divided between the two portions of a looped line.

Upon wear and possible damage to the looped mooring line, it is necessary to replace the old mooring line while maintaining the mooring line or leg in a connected position with its anchor on the sea floor.

SUMMARY OF THE INVENTION

This invention relates to any mooring line configured with both ends connected to a common mounting member on a vessel, with the mid point of the line looped through a sheave at the lower end for anchoring a vessel to the sea floor. This looped configuration provides a method and apparatus for installing a mooring line for a vessel, or for replacing an existing mooring line, and permits a moored vessel to remain moored to remaining anchor legs. This feature allows the use of a smaller diameter line as opposed to a single element configuration. The use of a smaller diameter line reduces the unpredictability of the spliced termination and allows for smaller, more compact handling equipment.

The old mooring line is connected to the new mooring line, and the new mooring line is payed out from one capstan while the old mooring line is hauled in about another capstan for replacement of the old mooring line. A mooring line remains connected about a sheave adjacent the sea floor secured to an anchor which is embedded in the sea floor during replacement of the old mooring line thereby to insure a against disconnection of the mooring line from the anchor.

Other features of the invention will be apparent from the following specification and drawings.

DESCRIPTION OF THE INVENTION

Figure 1:
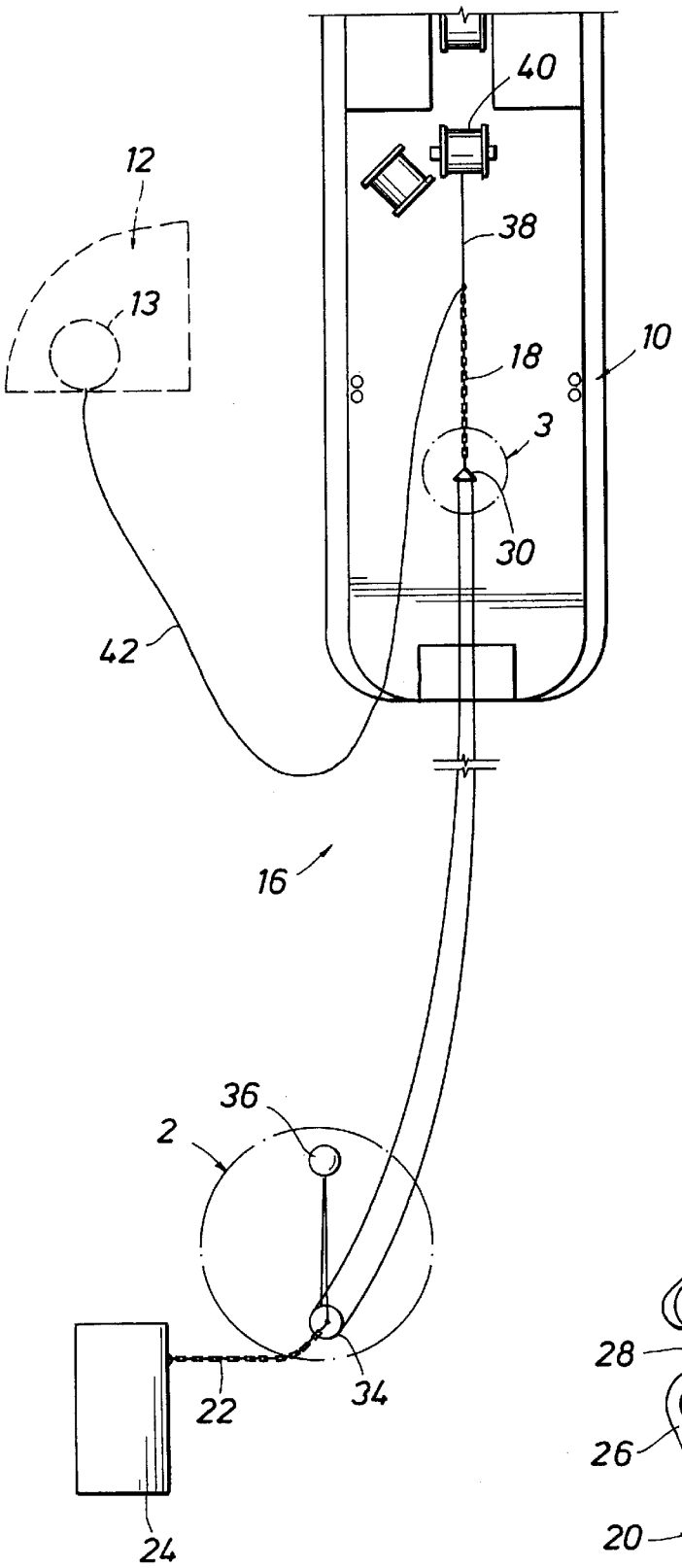
FIG. 1 is a schematic view of an old looped mooring line to be replaced and transferred to an anchor handling vessel (AHV) from a floating production, storage, and offloading vessel (FPSO) for replacement.

Referring to the drawings, an anchor handling vessel (AHV) is shown generally at positioned on the sea surface adjacent a main floating, production, storage, and offloading vessel (FPSO) 12 for servicing the main storage vessel 12. Vessel 12 normally has a plurality of mooring lines or legs which are anchored to the sea bed and are connected to a turret shown schematically at 13 on vessel 12 to permit weathervaning of vessel 12 about the turret. This method is also applicable to semi-submersible drilling rigs.

Figure 2:
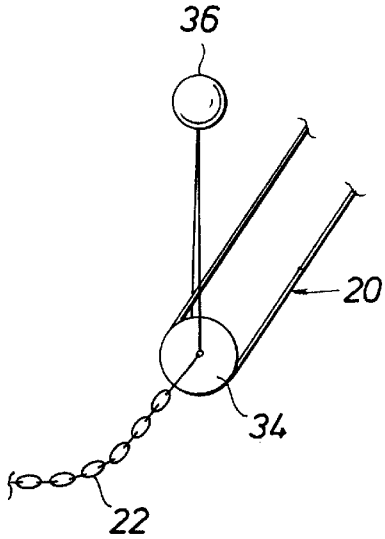
FIG. 2 is an enlarged fragment of FIG. 1, primarily schematic, showing the connection of the lower end of the looped mooring line to a subsea anchor.
Figure 3:
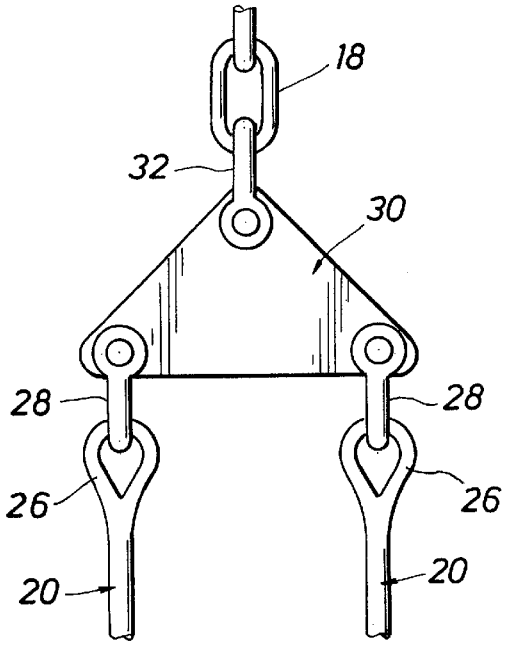
FIG. 3 is an enlarged fragment of FIG. 1 showing the connection of the upper end of the looped mooring line to an upper chain secured to a winch or capstan.

A typical mooring line for vessel 12 is shown generally at 16 detached from vessel 12 and mounted on service vessel 10. Mooring line 16 includes an upper chain 18 having an upper end for detachable connection to a turret, a looped non-metallic soft mooring line 20, and a lower chain 22 anchored to a piling 24 secured to the sea bed. Looped mooring line 20 as shown in FIG. 3 has ends with eyes 26 therein each connected by a clevis 28 to a triangular plate 30 with chain 18 pivotally connected to clevis 32. The lower end of looped mooring line 20 as shown in FIG. 2 extends about a pulley or sheave 34 which is vertically supported by a syntactic buoy 36 formed of high density buoyant foam material. It is desired to replace line 20 with a new line 20A and mooring leg 16 has been transferred from vessel 12 to service vessel 10 for this purpose as shown in FIG. 1.

For replacement of looped line 20, the mooring leg 16 is disconnected from turret 13 on main storage vessel 12. A cable 38 on winch 40 is connected to an end of chain 18 for transfer of mooring leg 16 from vessel 12 to vessel 10 as shown in FIG. 1. A winch cable or wire 42 from vessel 12 is used for transfer of mooring leg 16 to service vessel 10.

Figure 4:
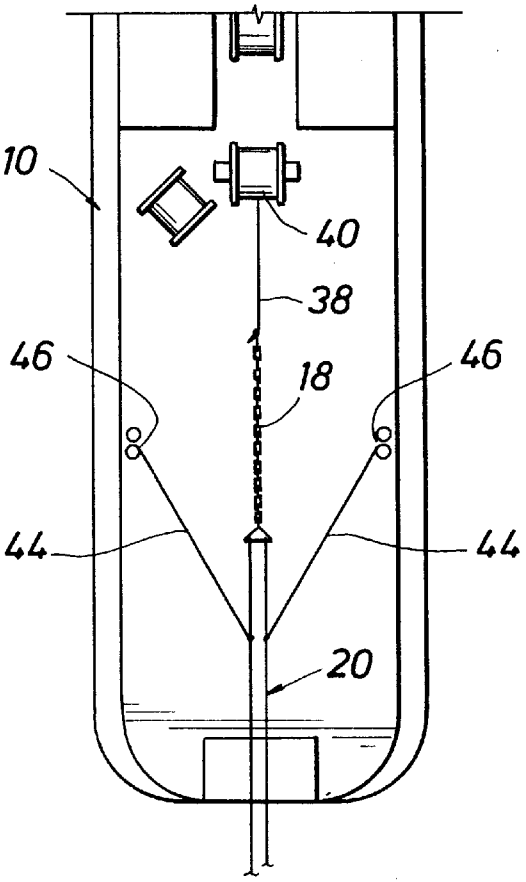

As shown in FIG. 4, looped line 20 is winched onto vessel 10. Tie-back lines 44 which are secured to vessel 10 at cleats 46 are connected to endless line 20. Chain 18 is next slackened by winch 40 while old looped line 20 is held by tie-back lines 44 with an end portion of looped line 20 between each eye 26 and the adjacent tie-back line 44 being untensioned. The remainder of line 20 is taut. Eyes 26 of old line 20 are then disconnected from plate 30.

Figure 5:
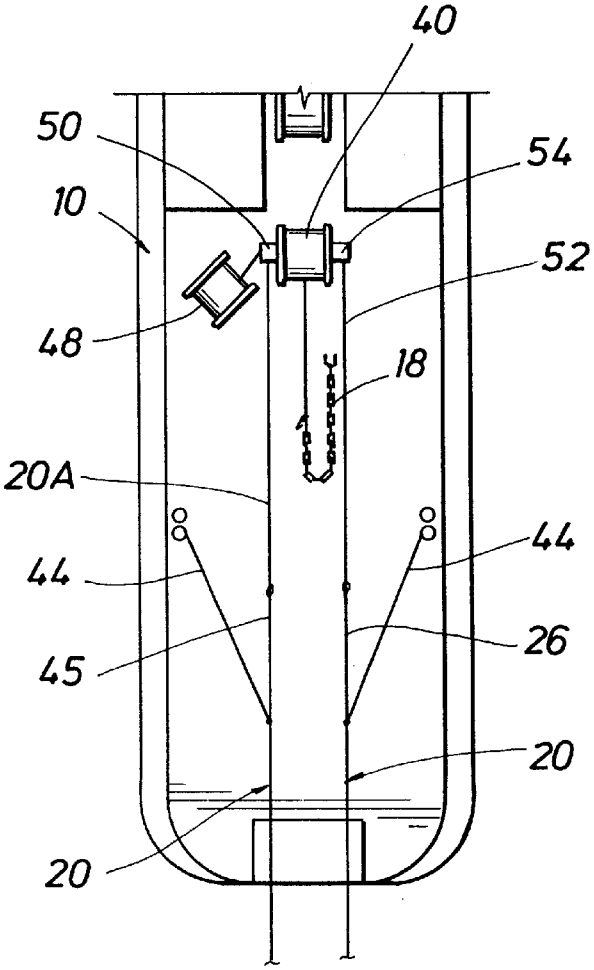
FIGS. 4–9 are schematic views illustrating in successive steps the replacement of the old looped mooring line with a new mooring line while a mooring line remains anchored to the sea floor.
Figure 6:
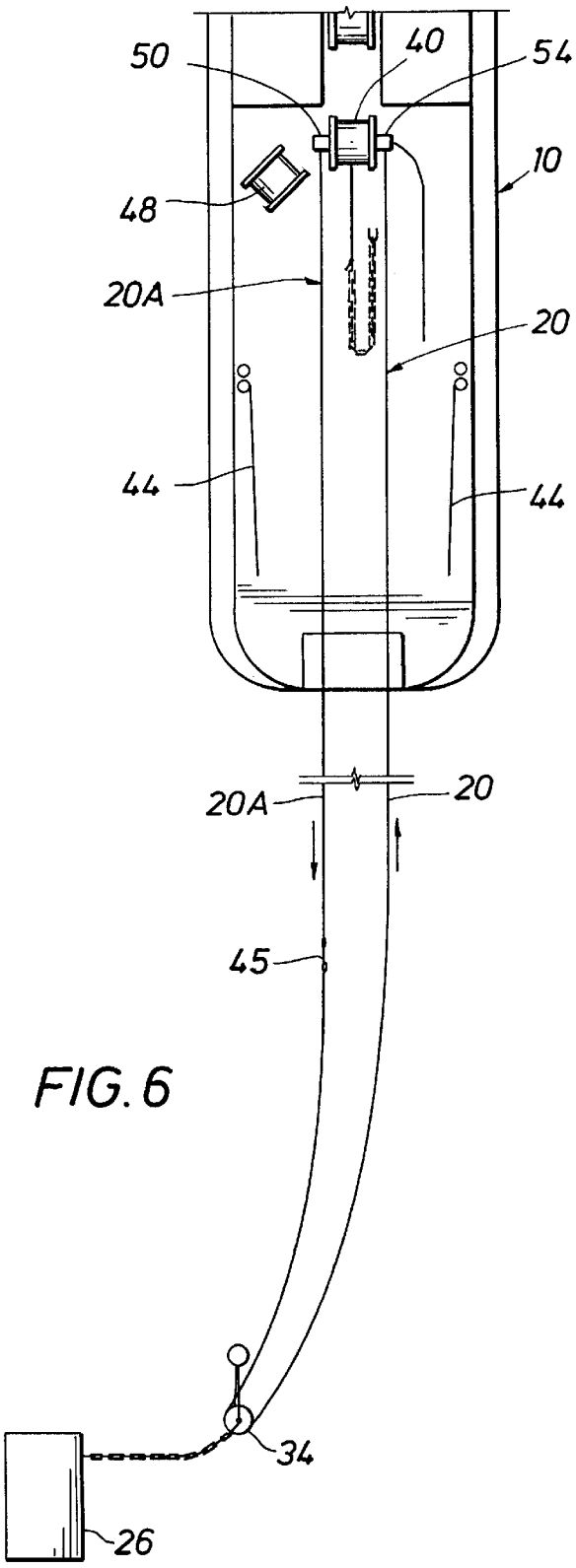

New replacement line 20A on reel 48 of vessel 10 is payed out (see FIG. 5) through capstan 50 and connected by a grommet 45 (see FIG. 6) to a cut end of old line 20 which has eye 26 cut off. Another line 52 is run from capstan, 54 and connected to the eye 26 of old mooring line 20 as shown particularly in FIG. 5. As shown in FIG. 6, old line 20 is hauled in by capstan 54 and new line 20A is payed out about sheave 34 by capstan 50.

Figure 7:
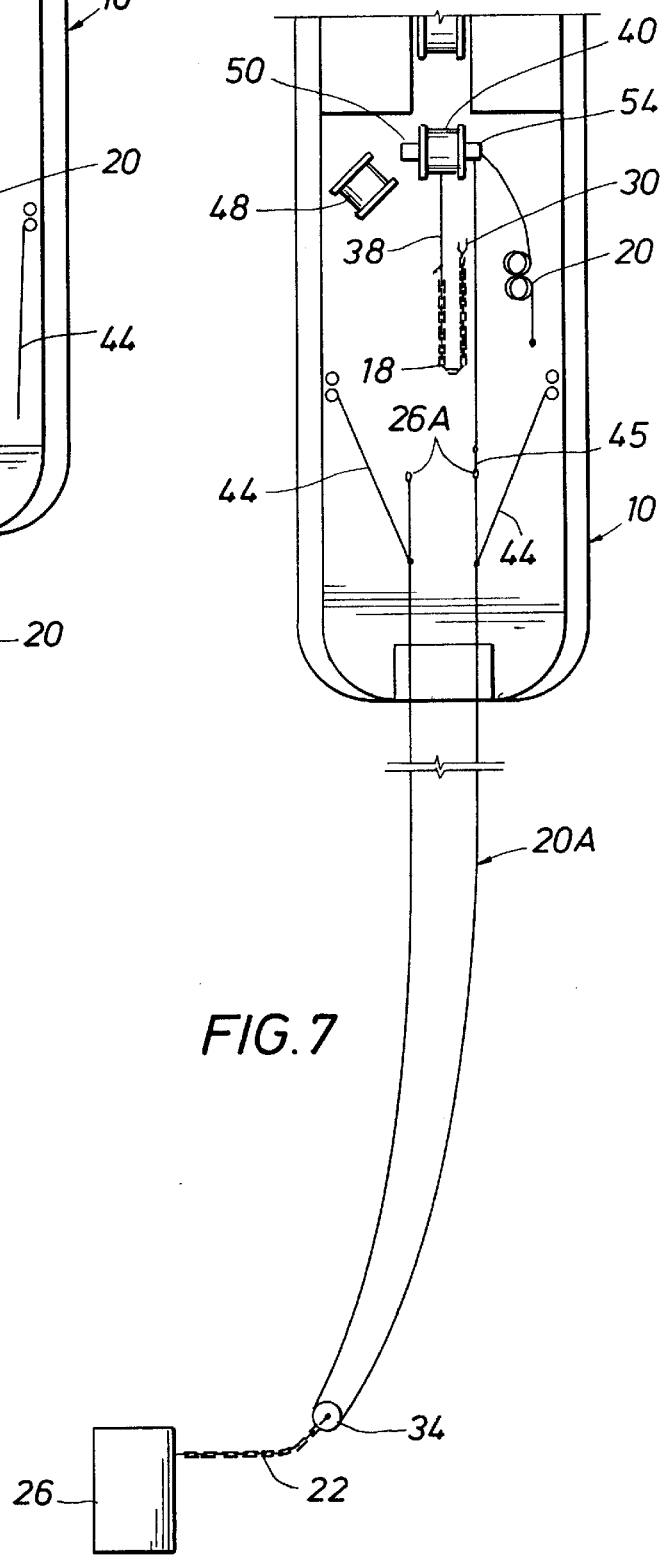

When the spliced ends of the old line 20 and new line 20A adjacent grommet 45 reach the deck of vessel, tie-back lines 44 are connected to new line 20A as shown in FIG. 7 with end eyes 26A being forwardly of tie-back lines 44. Grommet 45 which connects old line 20 to new line 20A is disconnected upon securement of the tie-back lines 44 to release old line 20 from new replacement line 20A. Then, eyes 26A on replacement line 20A are connected to plate 30 on chain 18 which is shown in FIG. 3. Tie-back lines 44 are then released from line 20A as shown in FIG. 8.

Figure 9:
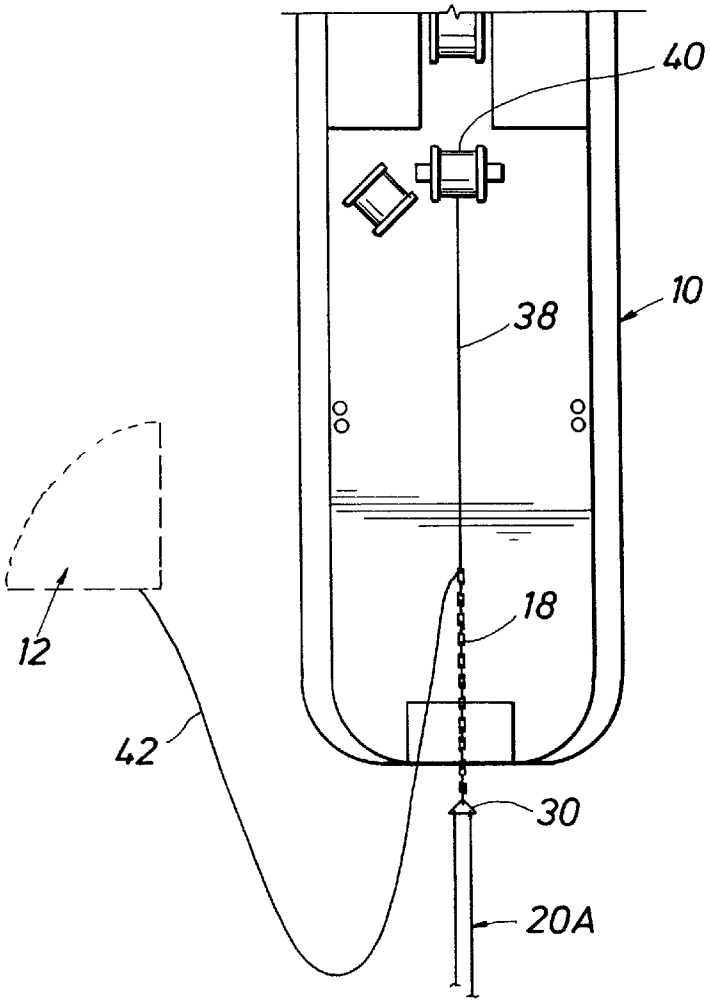
Figure 8:
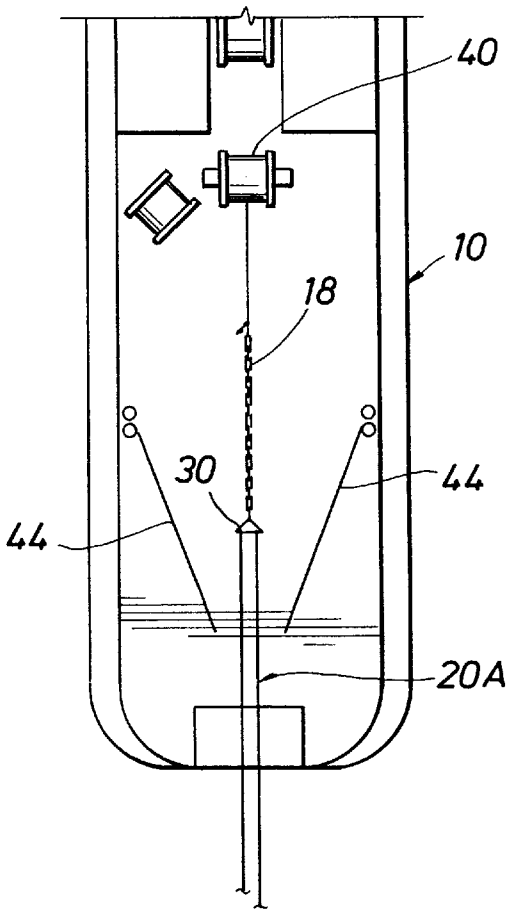

The winch wire or cable 42 from main vessel 12 is then connected to the end of chain 18, and chain 18 is payed out by winch 40 as shown in FIGS. 8 and 9. Cable 38 is next disconnected from winch wire 42. A winch on main vessel 12 connected to winch wire 42 hauls in winch cable 42 and chain 18 to the turret on main vessel 12. Chain 18 is releasably anchored to the turret by a suitable stopper as well known.

From the above, it is apparent that an improved method of replacing an existing looped non-metallic line, such as a polyester line, has been provided. While a separate vessel 10 has been illustrated for the replacement of an old looped line, it is apparent that the method could be performed by the main vessel without utilization of a separate vessel. Also, while tie-back lines 44 are shown as securing old line 20 for connection to new replacement line 20A, it is apparent that other tie-back means could be utilized in a satisfactory manner.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method of replacing an existing looped mooring line extending from a vessel to subsea anchor means, the looped mooring line extending about a sheave adjacent the subsea anchor means and having opposed ends removably connected to a mounting member on the vessel for securing the ends of the existing mooring line; said method comprising the following steps:

attaching first and second tie-back members to the existing mooring line adjacent respective first and second ends of said existing mooring line;

slackening said mounting member until the existing mooring line is secured by said tie-back members thereby to provide an untensioned end portion of the existing mooring line adjacent said tie-back members;

connecting a first end of a new looped replacement line to a first end of the untensioned end portion of said existing mooring line;

connecting pulling means to the second end of said existing mooring line;

disconnecting said first and second tie-back members from said first and second ends of said existing mooring line;

then pulling in said existing mooring line by pulling in said second end of said existing mooring line with said new replacement line connected to said first end of said existing mooring line until said new line is looped about said sheave and has opposed ends on said vessel;

then connecting first and second tie-back members to said new replacement line adjacent first and second ends of said new line where said first end of said new line is connected to said first end of said existing mooring line to provide an untensioned end portion of said new line adjacent said existing mooring line; and then disconnecting said existing mooring line from said new replacement line.

2. The method as set forth in claim 1 including the step of mounting opposed ends of said new replacement mooring line to said mounting member.

3. The method as set forth in claim 1 including the step of:

attaching a pair of separate tie-back members to the existing mooring line adjacent said opposed ends of said existing mooring line; and slackening said mounting member until the existing mooring line and said separate tie-back member are taut thereby to provide untensioned end portions of said existing mooring line between said mounting member and said tie-back member.

4. The method as set forth in claim 3 including the step of:

connecting said mounting member to a winch for pulling in and letting out the opposed ends of said existing mooring line and said replacement mooring line.

5. The method as set forth in claim 1 including the steps of:

providing a separate anchor handling vessel for serving a main storage and offloading vessel;

transferring an existing mooring line for the main storage and offloading vessel to the separate anchor handling vessel for replacement;

replacing the existing mooring line with the replacement mooring line in accord with the steps set forth; and then transferring the replacement mooring line to the main storage and offloading vessel.

6. The method as set forth in claim 1 including the step of:

forming said existing mooring line and said replacement mooring line of a relatively soft non-metallic material.

7. The method as set forth in claim 1 including the steps of:

providing an eye on each end of said existing mooring line and each end of said replacement mooring line; and connecting the eyes of said existing mooring line to said mounting member for securement of said existing mooring line.

8. A method as set forth in claim 7 including the steps of:

forming said mounting member of a plate; and connecting devises between said plate and said eyes of said existing mooring line for securement of said existing mooring line.

9. A method as set forth in claim 1 including the steps of:

mounting said replacement line on a reel for paying out upon connection to said existing mooring line; and connecting said existing line to a winch defining said pulling means for pulling in and winding said existing line onto a reel.

10. A method of replacing an existing mooring line for a moored floating, production, storage and offloading (FPSO) vessel for hydrocarbons, the existing mooring line being looped about a sea floor anchor means and having opposed ends removably coupled to a mounting member on the FPSO vessel; said method comprising the following steps:

removing the opposed ends of said existing mooring line from the FPSO vessel and transferring said opposed ends to an anchor handling vessel adjacent the FPSO vessel;

attaching a separate tie-back member to the existing mooring line adjacent an end of said existing mooring line;

slackening said mounting member until the existing mooring line is secured by said tie-back member thereby to provide an untensioned end portion of the existing mooring line adjacent said tie-back member;

connecting an end of a new looped replacement line to a first untensioned end portion of said existing mooring line;

connecting pulling means to a second end portion of said existing mooring line;

disconnecting said tie-back member from said existing mooring line;

then pulling in said existing mooring line with said new replacement line connected thereto until said new line is looped about said sea floor anchor means and has opposed ends on said vessel;

then connecting a tie-back member to said new replacement line adjacent an opposed end of said new line to provide an untensioned end portion adjacent said existing mooring line; and then disconnecting said existing mooring line from said untensioned end portion of said new replacement line.

11. The method as set forth in claim 10 wherein said FPSO vessel has a turret for connection of the existing mooring line thereto for weathervaning of the FPSO vessel about the turret and said method includes the steps of:

disconnecting the existing mooring line from the turret for transfer of the existing mooring line to said anchor handling vessel; and connecting the new replacement line to the turret of said FPSO vessel after replacement of the existing mooring line with the new replacement line.

12. The method as set forth in claim 10 including the steps of:

providing an eye on each end of said existing mooring line and each end of said replacement mooring line; and connecting the eyes of said existing mooring line to said mounting member for securement of said existing mooring line.

13. The method as set forth in claim 10 including the steps of:

forming said mounting member of a plate; and connecting devises between said plate and said eyes of said existing mooring line for securement of said existing mooring line.

14. A method of replacing an existing mooring line for a moored floating, production, storage and offloading (FPSO) vessel for hydrocarbons, the existing mooring line being looped about a sea floor anchor means and having opposed ends removably connected to mounting means on the FPSO vessel; said method comprising the following steps:

removing the opposed ends of said existing mooring line from the FPSO vessel and transferring said opposed ends to an anchor handling vessel adjacent the FPSO vessel;

attaching a pair of separate tie-back members to the existing mooring line adjacent said opposed ends of the mooring line;

slackening said mounting means until the existing mooring line is secured by said tie-back members thereby to provide first and second untensioned end portions of the existing mooring line adjacent said tie-back members;

connecting an end of a new looped replacement line to said first untensioned end portion of said existing mooring line;

connecting pulling means to said second untensioned end portion of said existing mooring line;

disconnecting said tie-back members from said existing mooring line;

then pulling in said existing mooring line with said new line connected to said existing mooring line and trailing said existing mooring line until said new line is looped about said sea floor anchor means and reaches said vessel;

then connecting a tie-back member to said new replacement line adjacent an opposed end of said new line to provide an untensioned end portion adjacent said existing mooring line;

disconnecting said existing mooring line from said untensioned end portion of said replacement line;

connecting said untensioned end portion of said new line to said mounting means;

then disconnecting said tie-back member from said new line for tensioning of said new replacement line; and transferring said new replacement line back to said FPSO vessel from said anchor handling vessel.

15. The method as set forth in claim 14 including the steps of:

providing an eye on each end of said replacement mooring line; and connecting the eyes of said replacement mooring line to said mounting means for securement of said replacement mooring line after disconnection of said existing mooring line from said replacement line.

16. Apparatus for replacing an existing looped mooring line extending from a FPSO vessel to subsea anchor means, the looped mooring line extending about a sheave adjacent the subsea anchor means and having opposed ends removably connected to a mounting member on the FPSO vessel for securing the ends of the existing mooring line; said apparatus comprising:

means for transferring said existing mooring line to an anchor handling vessel adjacent the FPSO vessel;

tie-back means attached to the existing mooring line adjacent said opposed ends of the mooring line to provide untensioned end portions of the existing mooring line adjacent said tie-back means;

means connecting an end of a new looped replacement mooring line to an untensioned end portion of said existing mooring line; and pulling means connected to the other untensioned end portion of said existing mooring line; said pulling means-pulling in said existing mooring line with said new line connected to said existing mooring line and trailing said existing mooring line until said new line is looped about said sea floor anchor means and reaches said anchor handling vessel; said existing mooring line being disconnected from said new replacement mooring line and transferred back to said FPSO vessel from said anchor handling vessel.

17. Apparatus for replacing an existing mooring line for a moored floating, production, storage and offloading (FPSO) vessel for hydrocarbons, the existing mooring line being looped about a sea floor anchor means and having opposed ends removably connected to the FPSO vessel; said apparatus comprising:

means for transferring said existing mooring line to an anchor handling vessel adjacent the FPSO vessel;

tie-back means attached to the existing mooring line adjacent said opposed ends of the existing mooring line to provide untensioned end portions of the existing mooring line adjacent said tie-back means;

means connecting an end of a new looped replacement mooring line to an untensioned end portion of said existing mooring line; and pulling means connected to the other untensioned end portion of said existing mooring line; said pulling means pulling in said existing mooring line with said new line connected to said existing mooring line and trailing said existing mooring line until said new line is looped about said sea floor anchor means and reaches said vessel;

said existing mooring line being disconnected from said new replacement mooring line and transferred back to said FPSO vessel from said anchor handling vessel.

18. Apparatus as set forth in claim 17 wherein:

an eye is positioned on each end of said existing mooring line and on each end of said new replacement mooring line; and mounting means on said anchor handling vessel engage the eyes of said new replacement mooring line for securing the new replacement mooring line after disconnected from said existing mooring line.

* * * * *